United States Patent [19]

Reinwall et al.

[11] Patent Number: 4,726,164

[45] Date of Patent: Feb. 23, 1988

[54] FASTENER ASSEMBLY FOR A ROOF MEMBRANE

[75] Inventors: Ernest W. Reinwall, McHenry; Robert A. Hagan, Roscoe, both of Ill.

[73] Assignee: Elco Industries, Inc., Rockford, Ill.

[21] Appl. No.: 26,023

[22] Filed: Mar. 16, 1987

[51] Int. Cl.[4] ..... E04B 1/62

[52] U.S. Cl. ..... 52/410; 52/512; 411/511

[58] Field of Search ..... 52/410, 512, 513; 411/184–189, 531, 545

[56] References Cited

U.S. PATENT DOCUMENTS

| | | | |
|---|---|---|---|
| 1,111,034 | 9/1914 | Robertson | 411/531 |
| 4,361,997 | 12/1982 | DeCaro | 52/512 |
| 4,380,413 | 4/1983 | Dewey | 411/161 |
| 4,574,551 | 3/1986 | Giannuzzi | 52/512 |
| 4,620,402 | 11/1986 | Beneze | 52/410 |
| 4,630,984 | 12/1986 | Reinwall et al. | 411/368 |

FOREIGN PATENT DOCUMENTS 2359309 7/1976 France .

*Primary Examiner*—James L. Ridgill, Jr.
*Attorney, Agent, or Firm*—Leydig, Voit & Mayer

[57] ABSTRACT

An assembly for fastening a flexible membrane to a layer of insulation on a roof deck includes a plastic disc and a threaded screw which, when tightened, clamps the disc to the membrane. Angularly spaced pins are formed integrally with and depend from the underside of the disc and bite into the membrane to help prevent edgewise tearing of the membrane when wind uplift forces are exerted on the membrane. The pins preferably are formed between the ends of radially extending and angularly spaced ribs which depend from the underside of the disc to resist upward flexing of the disc.

10 Claims, 6 Drawing Figures

FASTENER ASSEMBLY FOR A ROOF MEMBRANE

BACKGROUND OF THE INVENTION

This invention relates generally to a fastener assembly for securing a flexible roofing membrane to an underlying roof structure which is made up of an upper layer of insulation and a lower deck.

In certain modern roofing installations for commercial buildings, a layer of insulation is secured to the deck of the roof and then is covered with sheets of flexible material such as polyvinyl chloride. Adjacent margins of adjacent sheets are sealed together in overlapping relationship and thus the sheets form a sealing membrane over the insulation.

The sheets which form the membrane are secured to the insulation and the underlying roof deck at spaced locations by fastener assemblies which are spaced along the margins of the sheets. Each fastener assembly comprises a washer-like disc made of plastic and further comprises a screw adapted to thread into the roof deck to cause the disc to clamp the membrane downwardly against the insulation.

A fastener assembly of the same general type as the fastener assembly of the invention is disclosed in Reinwall et al U.S. Pat. No. 4,630,984. The plastic disc of that fastener assembly includes a central hub which penetrates the insulation and further includes a series of angularly spaced strengthening ribs which extend radially along the underside of the disc to reinforce the disc against upward flexing.

One of the problems presented by membrane-type roof installations involves uplift forces which tend to cause the membrane to billow upwardly. Wind blowing across the roof creates a negative pressure on the upper side of the membrane and, as a result, the membrane billows upwardly. While a fastener assembly of the type disolosed in the aforementioned Rèinwall et al patent is capable of adequately resisting the vertical force component of the billowing membrane, the horizontal force component tends to tear the membrane edgewise away from the hub of the clamping disc. Eventually, the membrane either rips completely away from the fastener assembly or is formed with unacceptably large tears.

SUMMARY OF THE INVENTION

The general aim of the present invention is to provide a roof fastener assembly of the above-general type and having a new and improved clamping disc which more effectively resists the edgewise forces of the membrane so as to reduce the danger of the membrane being torn away from beneath the disc by the horizontal component of the force applied to the membrane during upward billowing of the membrane.

A more detailed object is to achieve the foregoing by providing a fastener disc in which unique cleats are spaced angularly around the hub and bite into the membrane to prevent the membrane from tearing edgewise away from the hub.

Still another object of the invention is to shape the peripheral edge of the disc in such a manner as to enable the edge to dig into the membrane and coact with the cleats to effect secure clamping of the membrane.

The invention also resides in the unique shape of the cleats and in the novel positioning of the cleats between the ends of the reinforcing ribs of the disc in order to brace the cleats against flexing.

These and other objects and advantages of the invention will become more apparent from the following detailed description when taken in conjunction with the accompanying drawings.

DETAILED DESCRIPTION OF THE PREFERRED EMBODIMENT

Figure 1:
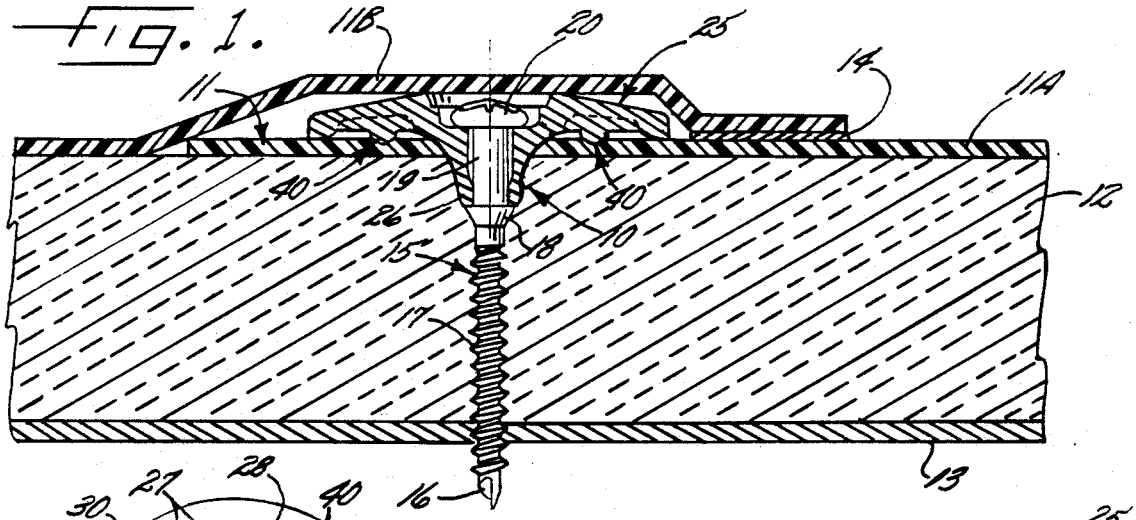
FIG. 1 is a sectional view of a roof construction utilizing a new and improved fastener assembly incorporating the unique features of the present invention.
Figure 2:
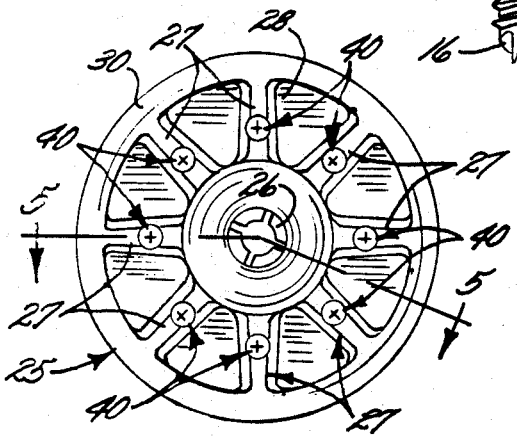
FIG 2 is a bottom plan view of the disc of the fastener assembly shown in FIG. 1.
Figure 3:
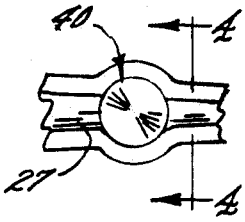
FIG. 3 is an enlarged fragmentary bottom plan view of one of the holding cleats and reinforcing ribs shown in FIG. 2.

For purposes of illustration, the invention is shown in the drawings as embodied in a fastener assembly 10 for securing a flexible roofing membrane 11 to a roof structure comprising an upper layer 12 of compressible insulation (e.g., styrofoam) which, in turn, is secured to a lower sheet metal roof deck 13. Fastener assemblies of the type disclosed in the aforementioned Reinwall et al patent may be positioned between the membrane 11 and the insulation 12 and used to secure the latter tightly to the deck 13.

The membrane 11 may be a flexible and waterproof material such as polyvinyl chloride having a thickness of about 1/32". One sheet 11A of such material is rolled out across the insulation 12 and is clamped thereto at longitudinally spaced points along one longitudinal edge portion of the sheet by fastener assemblies 10 of the invention. Thereafter, another sheet 11B is rolled out with its longitudinally extending edge portion in overlapping relation with the adjacent edge portion of the sheet 11A and in covering relation with the fastener assemblies 10. The composite membrane 11 is formed by heat-sealing the edge portion of the sheet 11A to the sheet 11B as indicated at 14 in FIGS. 1 and 6. The seal 14 may be made either before or after the sheets 11A and 11B have been rolled out across the insulation 12.

In many respects, the fastener assembly 10 of the invention is similar to that disclosed in the aforementioned Reinwall et al patent. Thus, the fastener assembly includes an elongated metal screw 15 having a self-drilling tip 16, a self-tapping thread 17 located above the tip, an enlarged and downwardly tapered collar 18 located above the thread, a plain shank portion 19 and an enlarged driving head 20.

The fastener assembly 10 also includes a washer-like disc 25 made of a suitable plastic such as molded polypropylene. The disc is circular in shape and its center portion is formed with a depending hub 26 (FIG. 5) which is shaped to penetrate the membrane 11A and the insulation 12. A plurality (herein, eight) of angularly spaced ribs 27 depend from the lower side 28 of the disc and extend radially from the hub 26 to an annular flange or contact pad 30 formed integrally with and depending from the outer periphery of the disc. The ribs strengthen the disc and reinforce the disc against upward flexing. In this instance, the lower surfaces 31 of the ribs are spaced above the lower surface 32 of the contact pad and thus the ribs do not normally engage the membrane 11A.

Figure 5:
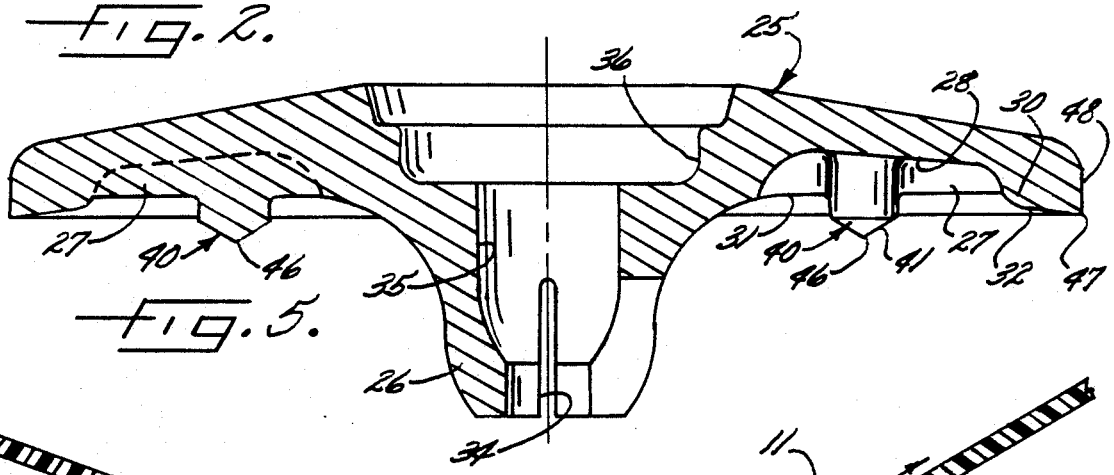
FIG. 5 is an enlarged cross-section taken substantially along the line 5—5 of FIG. 2.

As shown in FIG. 5, the hub 26 is slotted as indicated at 34' and is formed with a central hole 35 for receiving the screw 15. When the screw is placed in the hole and is tightened, it drills and threads through the insulation 12 and the deck 13 until the tapered collar 18 of the screw snaps through the slotted and yieldable hub 26. At this time, the head 20 of the screw 15 engages the bottom of a counterrecess 36 (FIG. 5) at the upper end of the hub. With further tightening of the screw, the hub 26 is drawn downwardly into the insulation 12 while the contact pad 30 is clamped tightly against the membrane 11A. In the finally installed position of the fastener assembly 10, the upper end of the collar 18 engages the lower end of the hub 26 to prevent the screw 15 and the disc 25 from shifting axially relative to one another.

Figure 6:
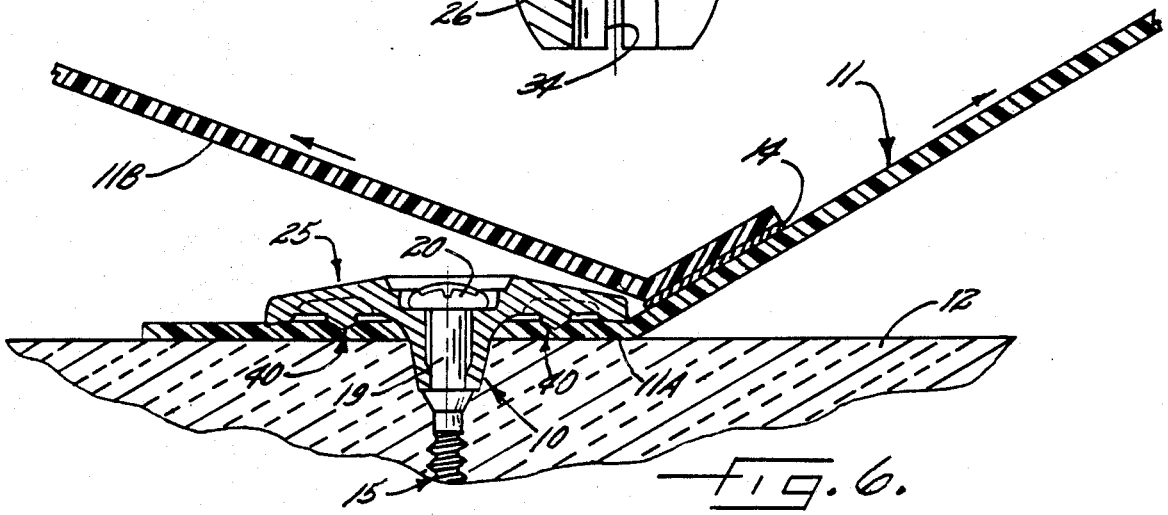
FIG. 6 is a fragmentary view generally similar to FIG. 1 but showing, on a greatly exaggerated scale, the effect of the membrane billowing upwardly due to uplift forces.

Under certain wind conditions, a negative pressure is created above the membrane 11 as the wind strikes the side of the building and is deflected upwardly. In these conditions, the positive pressure in the building leaks upwardly through cracks and seams in the deck 13 and the insulation 12 and causes the membrane 11 to billow upwardly. A rather exaggerated billowed condition is shown in FIG. 6 and, as illustrated, the sheet 11A which is held by the fastener assembly 10 tends to be pulled upwardly and outwardly away from the insulation 12 by the positive pressure between the sheet and the insulation.

As described thus far, the fastener assembly 10 is capable of resisting the vertical component of the uplift force applied to the membrane 11A. By virtue of the contact pad 30 clamping the membrane downwardly around an annular clamping area, the membrane is held securely against vertical forces.

In accordance with the present invention, the disc 25 is provided with unique means which resist the horizontal component of the uplift force and prevent the membrane 11A from tearing edgewise away from the disc. In the preferred embodiment, these means comprise a series of angularly spaced protrusions or cleats 40 which bite into the membrane and hold the latter securely against horizontall directed forces.

More specifically, the present disc 25 includes eight angularly spaced cleats 40 which, in the present instance, are in the form of generally cylindrical pins. The lower end portion of each pin is tapered downwardly as indicated at 41 in FIGS. 4 and 5 so as to form a relatively sharp point 46 at the extreme lower end of the pin. The sharp points enable the pins to penetrate and dig into the membrane 11A.

While the pins 40 could be located between adjacent ribs 27, each pin herein is molded integrally with a rib and is located about midway between the inner and outer ends of the rib. Each pin thus is strengthened against flexing by virtue of the rib reinforcing the joint between the upper end of the rib and the lower side 28 of the disc 25.

Figure 4:
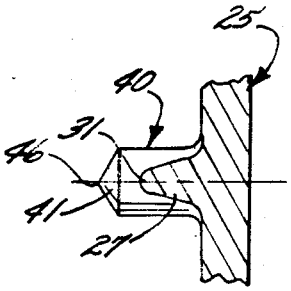
FIG. 4 is a fragmentary cross-section taken substantially along the line 4—4 of FIG. 3.

As shown most clearly in FIGS. 4 and 5, the lower end portions of the pins 40 project downwardly to a substantially greater depth than the lower sides 31 of the ribs 27. In this particular case, each pin has a major diameter of about 0.125" and projects downwardly from the lower side of the associated rib by a distance of about 0.085".

When the screw 15 is tightened, the angularly spaced pins 40 penetrate and bite into the membrane 11A as shown in FIGS. 1 and 6. As a result, the pins resist horizontal or edgewise forces applied to that portion of the membrane 11A below the disc 25 and thus prevent the membrane from tearing away from the hub 26 and tearing from beneath the disc.

To help the pins 40 hold the membrane 11A, the outer and lower corner of the contact pad 30 is, pursuant to the invention, formed as a sharp edge 47 (FIG. 5) which is capable of digging into the membrane. For this purpose, the lower side 32 of the contact pad 30 is inclined at an angle of about seven degrees relative to horizontal and slopes downwardly upon progressing outwardly. The outer side 48 of the pad is either vertical or is slightly inclined in a direction such that the included angle between the outer and lower sides of the pad is acute. During the molding operation, the edge 47 is made as sharp as possible and thus is effective to dig into the membrane 11A and help the pins 40 resist edgewise pulling of the membrane.

From the foregoing, it will be apparent that the present invention brings to the art a new and improved fastener assembly 10 in which the depending pins 40 on the underside of the disc 25 bite into the membrane 11A and coact with the sharp edge 47 of the contact pad 30 to resist forces applied edgewise to the membrane. By forming the pins between the ends of the ribs 27, the ribs serve as braces to strengthen the pins against flexing.

We claim:

1. An assembly for fastening a flexible roof membrane to an underlying structure comprising an upper layer of insulation and a lower roof deck, said assembly comprising a disc made of plastic and having upper and lower sides, a tubular hub depending from the lower side of said disc near the center thereof and shaped to penetrate said membrane and said insulation, a screw extending through said hub and adapted to be threaded through said insulation and into said deck, said screw having a head engageable with said disc and operable to clamp said disc downwardly against said membrane when said screw is tightened, a plurality of angularly spaced and radially extending ribs depending from the lower side of said disc to reinforce the disc against upward flexing, said disc being characterized by the provision of a plurality of cleats spaced angularly around said hub and projecting axially from the lower side of said disc to a depth below the lower surfaces of said ribs, said cleats being shaped to bite into said membrane and preventing said membrane from being pulled edgewise from beneath said disc when wind uplift forces are exerted on said membrane.

2. An assembly as defined in claim 1 in which said cleats are shaped as generally cylindrical pins, the lower end portion of each pin being tapered downwardly to form a point.

3. An assembly as defined in claim 1 in which said cleats are in the form of pins having a generally circular cross-section, said pins being formed integrally with and depending from the lower sides of said ribs between the ends thereof.

4. An assembly as defined in claim 1 further including an annular pad formed integrally with and projecting downwardly from the lower side of said disc around the outer periphery thereof, the outer and lower edge of said pad being sharp so as to dig into said membrane when said screw is tightened.

5. An assembly as defined in claim 4 in which the lower side of said pad slopes downwardly upon progressing outwardly so as to cause the outer and lower edge of said pad to be sharp in a downwardly facing direction.

6. An assembly as defined in claim 5 in which the included angle between the lower and outer sides of said pad is less than 90 degrees.

7. An assembly for fastening a flexible roof membrane to an underlying structure comprising an upper layer of insulation and a lower roof deck, said assembly comprising a disc made of plastic and having upper and lower sides, a tubular hub depending from the lower side of said disc near the center thereof and shaped to penetrate said membrane and said insulation, a screw extending through said hub and adapted to be threaded through said insulation and into said deck, said screw having a head engageable with said disc and operable to clamp said disc downwardly against said membrane when said screw is tightened, a plurality of angularly spaced and radially extending ribs depending from the lower side of said disc to reinforce the disc against upward flexing, said disc being characterized by a plurality of pins spaced angularly around said hub and alined angularly with said ribs, said pins being located between the ends of said ribs and projecting axially from the lower side of said disc to a depth below the lower surfaces of said ribs, said pins being shaped to penetrate said membrane when said screw is tightened and preventing said membrane from being pulled edgewise from beneath said disc when wind uplift forces are exerted on said membrane.

8. An assembly as defined in claim 7 in which each pin is of circular cross-section, the lower end portion of each pin being tapered downwardly to form a point at the extreme lower end of the pin.

9. An assembly as defined in claim 7 further including an annular pad formed integrally with and projecting downwardly from the lower side of said disc around the outer periphery thereof, the outer and lower edge of said pad being sharp so as to dig into said membrane when said screw is tightened.

10. An assembly as defined in claim 9 in which the lower side of said pad slopes downwardly upon progressing outwardly and is inclined at an acute included angle relative to the outer side of said pad so as to cause the outer and lower edge of said pad to be sharp.

* * * * *